US005904579A

United States Patent [19]

McLean et al.

[11] Patent Number: 5,904,579

[45] Date of Patent: May 18, 1999

[54] RIGHT-ANGLE ADAPTOR FOR COAXIAL JACKS

[75] Inventors: Norris B. McLean, Englewood; Mark G. Spaulding, Florham Park, both of N.J.

[73] Assignee: Lucent Technologies Inc., Murray Hill, N.J.

[21] Appl. No.: 08/960,689

[22] Filed: Oct. 29, 1997

[51] Int. Cl.[6] ..... H01R 9/09

[52] U.S. Cl. ..... 439/63; 439/944

[58] Field of Search ..... 439/63, 581, 582, 439/944

[56] References Cited

U.S. PATENT DOCUMENTS

| | | | |
|---|---|---|---|
| 3,551,874 | 12/1970 | Volinskie | 439/63 |
| 4,273,407 | 6/1981 | Snuffer | 439/581 |
| 4,645,288 | 2/1987 | Stursa | 439/63 |
| 4,815,104 | 3/1989 | Willaims et al. . | |
| 5,233,501 | 8/1993 | Allen et al. . | |
| 5,547,400 | 8/1996 | Wright | 439/63 |

OTHER PUBLICATIONS

AMP Product Sheet—BNC Self–Terminating Connectors, Jun. 1994, p. 57.

*Primary Examiner*—Steven L. Stephan
*Assistant Examiner*—Javaid Nasri

[57] ABSTRACT

A right angle adaptor for a straight coaxial jack having a jack body (10) and at least one jack terminal (48) extending axially from a base of the jack body. The adaptor includes an adaptor board having at least one jack terminal opening for receiving a jack terminal that extends axially from a base of a coaxial jack body. The adaptor board (200) has at least one adaptor terminal (48) mount, and a conductive path that electrically connects the adaptor terminal mount to a corresponding jack terminal opening in the adaptor board. At least one adaptor terminal has one end part electrically connected to an adaptor terminal mount on the adaptor board, and an opposite end part of the adaptor terminal extends substantially parallel to the adaptor board for connection with an outside board.

14 Claims, 8 Drawing Sheets

RIGHT-ANGLE ADAPTOR FOR COAXIAL JACKS

CROSS-REFERENCE TO RELATED APPLICATION

Copending U.S. patent application Ser. No. 08/948,456, filed Oct. 10, 1997, entitled Coaxial Jack With an Internal Switch Mechanism, and assigned to the assignee of the present invention.

BACKGROUND OF THE INVENTION

1. Field of the Invention

The present invention relates to coaxial jack constructions, and particularly to a right-angle adaptor for a coaxial jack.

2. Discussion of the Known Art

Type 440 coaxial jacks, which are compatible with type 440 plugs, are known generally for use in telephone cross-connect systems. One such system, known as System III DSX-¾, has been used in telecommunication networks in the United States for the past seven years. The system is used to cross-connect DS3, STS1, STS3 or DS4 level signals manually at a central office.

A building block of the System III DSX-¾ is called a DSX-¾ module. This module has a 3-inch by 3-inch by 0.5 inch die cast metal case. The case houses a jack set comprised of five conventional type 440 jacks, and three mechanical switches interposed externally between four of the jacks. The switches have activators and contacts that enter side openings in the jack barrels to sense an inserted plug. See, e.g., U.S. Pat. No. 4,815,104 (March 1989). The five type 440 jacks open on a front panel of the case, and two bulk head type BNC jacks are mounted on a rear panel of the case. Other components inside the case include two hand-soldered coaxial cables, a metal housing for the five type 440 jacks, three resisters, and one inductor. The module is also known as a 1201A jack set.

The internal component layout in the 1201A jack set is very difficult to modify. This makes additional features very difficult to provide, since only a limited number of coaxial cables can fit inside the jack set, and routing the cables requires extreme care to maintain consistent transmission performance. It would therefore be desirable to incorporate a printed wiring board in a 1201A jack set for mounting of all components and routing all signal lines. See U.S. Pat No. 5,233,501 (August 1993).

Another cross-connect system, the DIXI-3, has been used in telecommunication networks in the United States for the past three years. The DIXI-3 system is used to interconnect and cross-connect DS3, STS1 and STS3 signals manually in a central office.

A building block of the DIXI-3 system is the DIXI-3 module. This module has a 0.75-inch by 5.5-inch by 6.0-inch plastics case which houses a printed wiring board with eight right-angle BNC connectors. Because the DIXI-3 system is a rear-cabled rear cross-connected system, four BNC connectors are located at a rear end of each module and four BNC connectors are located at a front end of the module. The BNC connectors at the rear are for cabling and cross-connecting operations, and the BNC connectors at the front are for patching and monitoring. Migration from the earlier mentioned DSX-3 system with 440 jacks to a DIXI-3 system, would be simplified if the BNC jacks for patching and monitoring on the DIXI-3 modules are replaced by type 440 jacks.

Accordingly, there is a need for an adaptor that will allow a straight (e.g., type 440) coaxial jack to be mounted at a right-angle on a printed wire board. Preferably, such an adaptor should accommodate jacks having a number of axial terminals some of which may lead to an internal jack switch mechanism of the kind disclosed herein.

SUMMARY OF THE INVENTION

According to the invention, a right-angle adaptor for a straight coaxial jack, includes an adapter board having at least one jack terminal opening dimensioned to receive a jack terminal that extends axially from a base of a coaxial jack, the board having at least one adaptor terminal mount and a conductive path that electrically connects the adaptor terminal mount to a corresponding jack terminal opening in the board, and at least one adaptor terminal one end part of which is connected to an adaptor terminal mount on the board and an opposite end part of which extends substantially parallel to the board to engage part of an outside board to which a jack terminal of the coaxial jack is to be connected.

For a better understanding of the invention, reference is made to the following description taken in conjunction with the accompanying drawing, and the scope of the invention will be pointed out in the appended claims.

DETAILED DESCRIPTION OF THE INVENTION

Figure 1:
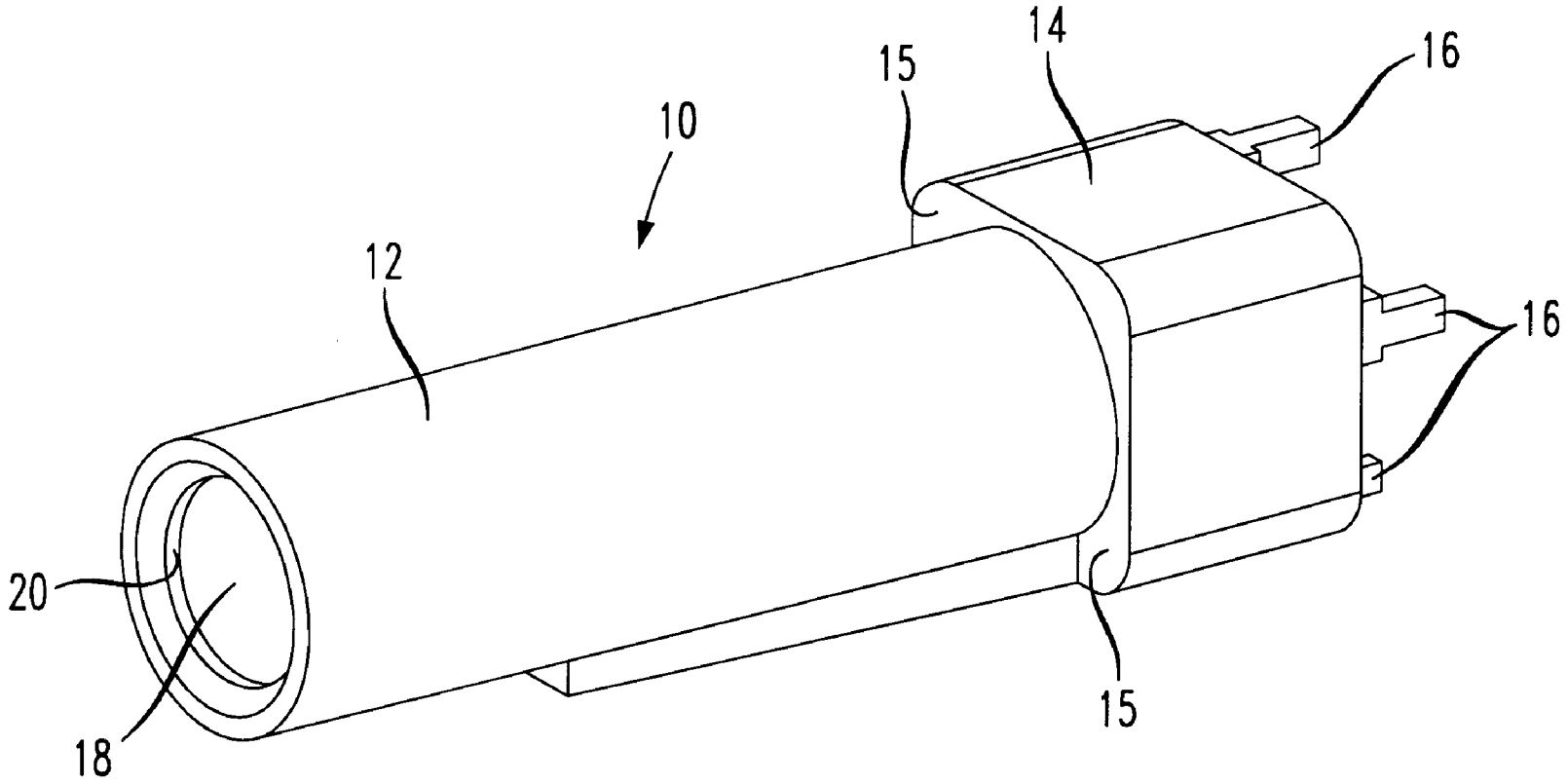
FIG. 1 is a perspective view of a straight coaxial jack.

FIG. 1 is a perspective view showing the exterior of a coaxial jack 10. The jack 10 comprises an outer cylindrical barrel housing 12 made, for example, from a molded metalized plastics material or metal such as a zinc alloy to conduct a ground potential. A generally rectangular base portion 14 houses a jack switch contact support 40 (see FIGS. 2 & 3). The base portion 14 is preferably formed integrally with the cylindrical barrel housing 12, and forms ledges 15 that facilitate manual handling and mounting of the jack 10 when assembled into a jack module.

The jack base portion 14 in FIG. 1 also has a number (e.g., four) of compliant mounting pins or lugs 16 projecting axially from the bottom edge of the base portion in a defined pattern to engage corresponding mounting holes in a printed wiring board. The barrel housing 12 has a cylindrical, electrically conductive spring shell 18 supported coaxially along the inner periphery of the housing 12. The shell 18 and the housing 12 together define an axial front opening 20. The shell 18 also defines a path of travel when a mating coaxial plug (not shown) is inserted in the jack 10 through the front opening 20.

If applied for use as a type 440 jack, the front opening 20 of the barrel housing 12 has a diameter of typically 0.300 inches. The combined length of the barrel housing 12 and base portion 14, excluding the pin projections 16, is typically 1.870 inches. The length of the pin projections 16 is typically 0.165 inches. The base portion 14 of the jack 10 has, for example, a square cross-section measuring 0.490 inches on a side.

Figure 2:
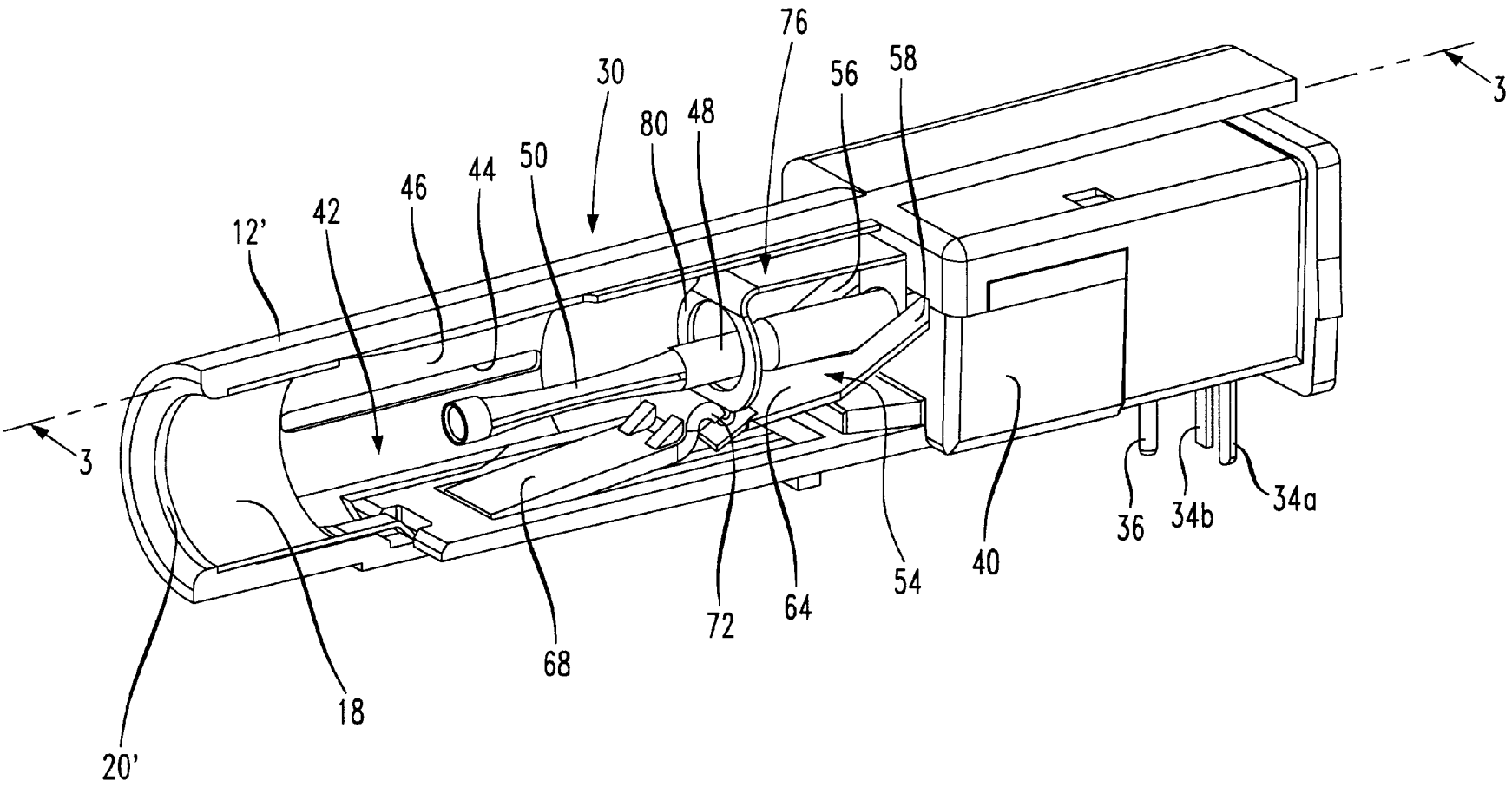
FIG. 2 is a perspective view of a "right angle" coaxial jack.
Figure 3:
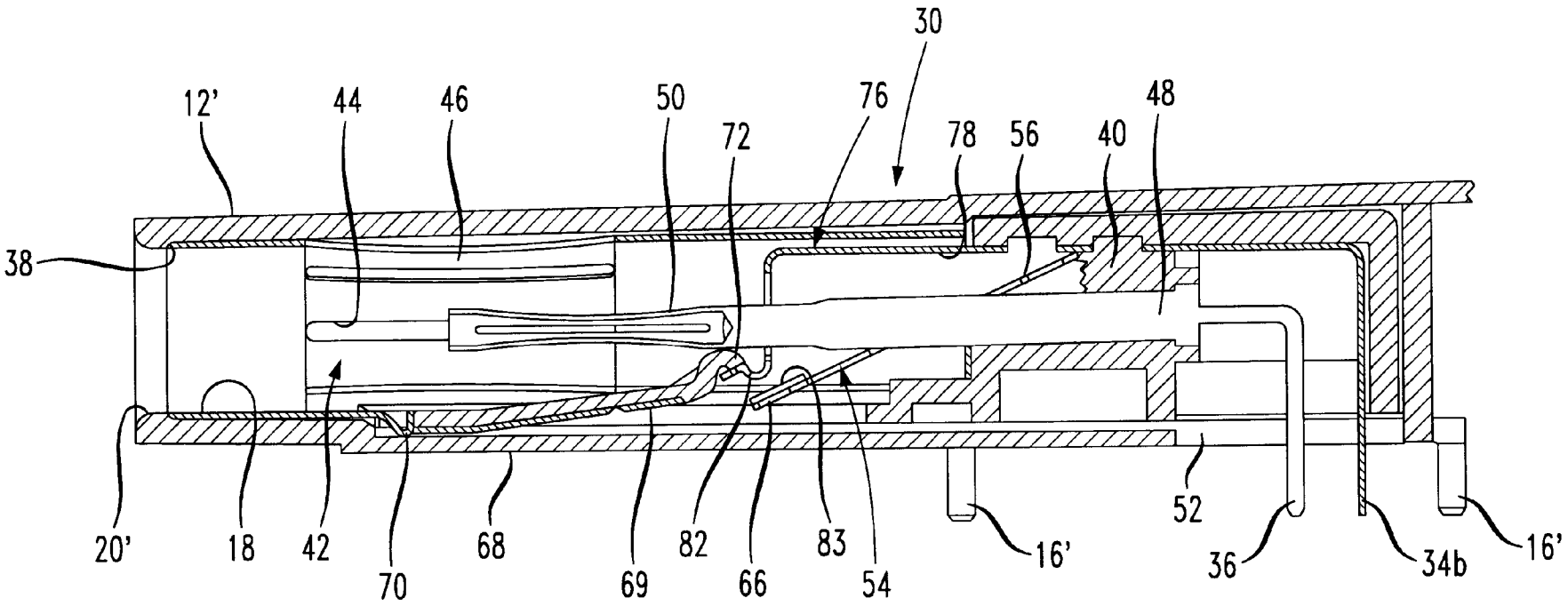
FIG. 3 is a sectional view of the jack in FIG. 2 taken along line 3—3.

The jack 10 in FIG. 1 has an internal switch mechanism which is described in detail with respect to the embodiment of FIGS. 2 and 3. Switch contact terminals and a terminal for a jack center conductor (not shown in FIG. 1) protrude axially in a determined pattern from the base portion 14 to engage corresponding terminal openings in a printed wiring board.

FIGS. 2 and 3 are views of a coaxial jack 30. The basic structure of the jack 30 differs from that of the jack 10 in FIG. 1 by the provision of right-angled jack mounting pins 16', switch contact terminals 34*a,* 34*b,* and jack center conductor terminal 36 for engaging corresponding openings in a printed wiring board. Parts of the jack 30 in FIGS. 2 and 3 that correspond to parts of the jack 10 in FIG. 1, have corresponding reference numerals.

The jack shell 18 fits snugly along the inner periphery of the barrel housing 12' and is locked against axial movement by an annular lip 38 that protrudes radially inward from the housing 12' at the jack front opening 20', and the switch contact support 40 fixed at a back portion of the shell 18 inside barrel housing 12'. A section 42 of the shell 18, near the jack front opening 20', has a number of axially extending slots 44 equi-circumferentially spaced from one another resilient, reduced diameter portion or constriction 46 in the shell section 42. When a mating plug connector (not shown) is inserted in the front opening 20', the plug body slides against and is held frictionally in place by the spring constriction 46. An effective, sliding electrical (e.g., ground) contact is thus established between the shell 18 and the outside body of the plug connector.

An elongate center conductor 48 is supported coaxially inside the shell 18 by the switch contact support 40 or equivalent means fixed in the housing 12' at the back portion of the shell. The center conductor extends axially toward the front opening 20', and has a tubular front end 50 that is radially constricted. The front end 50 is dimensioned to receive and to engage fictionally a center pin of a mating plug connector, and to establish an electrical connection between the center conductor 48 and the plug center pin. The center conductor terminal 36 extends axially from the back of the center conductor, bends 90 degrees to pass through a clearance opening 52 in the housing 12', and projects radially a certain distance outside the housing.

A first switch contact 54 inside the jacks 10, 30 is in the form of an elongate, generally "Y"-shaped resilient metallic strip. Arms 56, 58 of the contact 54 have back ends that are fixed by the switch contact support 40, at a side of the shell axis above the center conductor 48 as viewed in FIG. 2. The switch contact 54 extends from the contact support 40 through the shell 18 toward the front opening 20' with a determined inclination, for example, about 20 degrees with respect to the shell axis. The arms 56, 58 pass diametrically opposed sides of the center conductor 48 as seen in FIG. 2, but edges of the arms do not contact the center conductor.

Arms 56, 58 join at a fork 64 of the contact 54, and a free end 66 of the contact 54 is positioned on a side of the shell axis below the center conductor as viewed in FIG. 2. The fork 64 is so positioned and configured as to have an inner edge extending between the arms 56, 58 make electrical contact with the center conductor 48 in the absence of a mating plug in the shell. Preferably, the fork 64 exerts a certain preload contact force against the center conductor 48, for example, by making it necessary to urge the contact arms 56, 58 radially downward when assembling the jack to allow the center conductor 48 to slide between the arms, and over and against the inner edge of the fork 64. One of the arms (e.g., arm 58) continues to extend axially from the support 40 toward the back of the housing 12', turns at a right-angle to exit the clearance opening 52, and projects from the jack housing to form the switch contact terminal 34*a*.

An elongate actuator 68 is supported for pivotal movement on the inner periphery of the shell 18, on a spring leaf 69 formed in the shell section 42. The actuator 68 is located on the same side of the shell axis as the free end 66 of the first switch contact 54. Actuator 68 extends axially toward the back of the shell 18, and an engaging part 72 at the rear end of the actuator protrudes in the plug travel path inside the shell 18. The engaging part 72 is configured to cause the free end 66 of the first switch contact 54 to deflect by an amount sufficient to break the electrical connection between the contact 54 and the center conductor 48, when a plug inserted in the shell 18 displaces the engaging part 72. Prior to displacing the free end 66 of the first switch contact 54, the actuator 68 displaces a second switch contact 76 which is constructed and arranged as follows.

The second switch contact 76 has a generally "L"-shaped profile, wherein a long "leg" 78 of the contact has a back end fixed by the switch contact support 40, at the same (upper) side of the shell axis at which the back ends of the first switch contact arms 56, 58 are fixed by the support 40. The leg 78 extends inside the shell 18 substantially parallel to the shell axis, and bends at substantially a right angle to form an open ring 80 through which the center conductor 48 clearly passes out of contact with the ring 80. The ring 80 has a bottom contact hook 82 on the same side of the shell axis as the free end of first switch contact 54. The engaging part 72 of the actuator 68 rests on the hook 82 of the second switch contact 76. The hook 82 and a contact pad 83 on the free end 66 of the first switch contact 54, form a determined gap between one another as seen in FIG. 3. The leg 78 of the second switch contact 76 also extends axially toward the back of the housing 12', turns at a right-angle to exit the clearance opening 52, and projects from the jack housing to form the switch contact terminal 34*b*.

When constructed as described herein, the coaxial jacks 10, 30 have a fully internal switch mechanism, with external switch contact terminals and jack mounting pins. The jacks are thus suitable for mounting on a printed wiring board whether upright (jack 10), or flush with a right-angle orientation (jack 30) relative to the board. In the illustrated embodiments, the internal switch mechanism is such that in the absence of a mating plug in the jack, the first switch contact 54 is in electrical contacting relation with the center conductor 48, and the potential of the center conductor 48 is on the switch terminal 34*a*. When a plug is inserted in the jack, a leading end of the plug body displaces the engaging part 72 of the actuator 68 inside the shell 18, and causes the actuator 68 to deflect downwardly in FIGS. 2 & 3 to urge the hook 82 of the second switch contact 76 against the contact pad 83 on the free end 66 of the first switch contact 54.

The engaging part 72 protrudes in the travel path of an inserted plug to such a degree that when deflected by the plug, it urges the hook 82 of the second switch contact against the free end 66 of the first switch contact and continues to deflect the both of them enough to break the electrical connection between the first switch contact 54 and the center conductor 48. Thus, when a plug is inserted in the jack, the first switch contact 54 breaks its electrical connection with the center conductor 48 and makes an electrical connection with the second switch contact 76. The opening in the ring 80 of the second switch contact 76 is large enough so that the second switch contact does not make electrical contact with the center conductor 48 when the former is fully deflected by the actuator 68. Accordingly, with a plug inserted in the jack, the external jack switch terminals 34*a*, 34*b* are internally connected to one another via the switch contacts 54, 76; and the center conductor terminal 36 is internally disconnected from terminal 34*a*.

Use of the present coaxial jack construction as a type 440 jack in a modified 1201A jack set (see FIGS. 4 and 6) can realize as much as a 50 percent reduction in manufacturing costs over present 1201A jack sets. A modified 1201A jack set with the present jacks will allow the use of a plastics case which significantly reduces weight. Further, a 440 jack made as disclosed herein will facilitate the creation of an expanded DSX-3 product family.

The construction and arrangement of the first and the second switch contacts 54, 76 gives each of them a long moment arm between a point at which the actuator 68 transmits a force on the contact, and points at the back ends of the contacts where they are fixed by the support 40, in a relatively narrow cross-section inside the jack shell 18. The advantage of such a long moment arm is that it allows for a large contact deflection before contact yield, and, thus, better switch reliability. Further, the placement of the switch actuator 68 on a leaf part of the metallic spring shell 18 improves transmission performance and reduces the number of parts. The switch terminals and mounting pins of the present jack allow a press-fit or solder interface with a printed wiring board and a minimal, "tweak-free" hand assembly. Wiping action between the fork 64 of first switch contact 54 and center conductor 48, and between second switch contact 76 and the contact pad 83 on first switch contact 54, ensures a high level of reliability.

Figure 4:
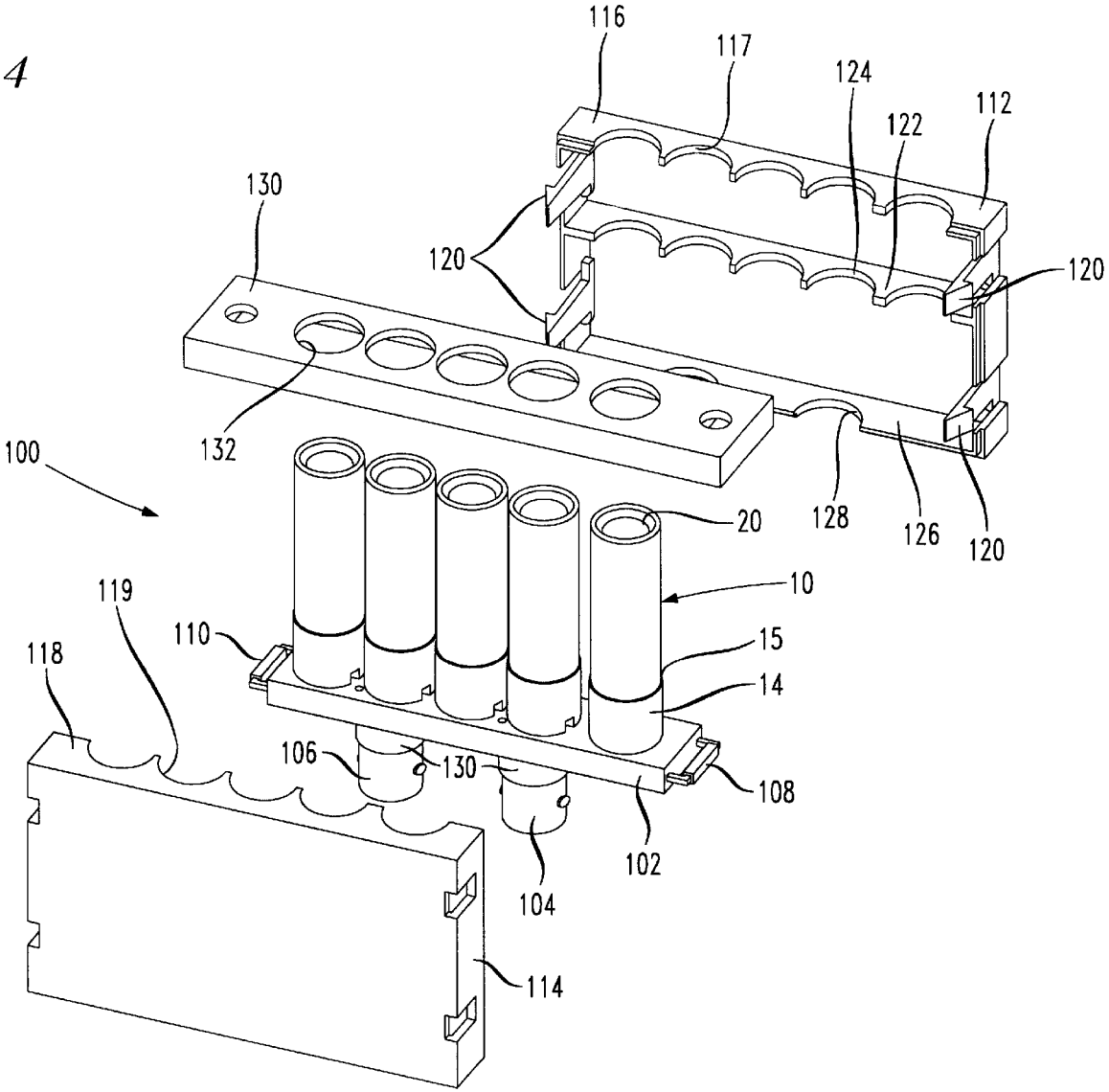
FIG. 4 is an assembly view of a connector module.

FIG. 4 is an assembly view of a connector module 100. The module 100 corresponds to the mentioned 1201A jack set and may be substituted for that module in current System III DSX-¾ telephone cross-connect systems.

The module 100 comprises an elongate, generally rectangular printed wiring board 102 on which printed wires (not shown) interconnect terminals of a pair of type BNC jacks 104, 106 mounted on a rear side of the board 102; and a set of five coaxial jacks 10 mounted on a front side of the board. External discrete components 108, 110 are mounted at axial ends of the board 102. The printed wiring board 102 with the coaxial connectors and components mounted thereon is fixed inside a half-casing 112 which, for example, is molded from a lightweight, plastics material.

Half-casing 112 and a mating half-casing 114, each have a front end wall 116, 118 with semi-circular cutouts 117, 119 that partly encircle front portions of the coaxial jacks 10 when the half-casings are snapped together via flexible locking tabs 120. The half-casings 112, 114 also have a transverse wall 122 with semi-circular cutouts 124. The walls 122 together encircle the circumference of coaxial jacks 10 at an axial position between the jack front openings 20 and their base portions 14 when the half-casings 112, 114 are joined to one another. The half-casings each have a back end wall 126 with two semi-circular cutouts 128 to encircle the BNC jacks 104, 106 when the half-casings are joined.

Preferably, the distance between the transverse wall 122 and the back end wall 126 of each half-casing corresponds to the axial distance between the ledges 15 on each of the jacks 10, and ledges 130 at base portions of the BNC jacks 104, 106. The printed wiring board 102 thus can be mounted between the transverse and back end walls 122, 126 of the half-casing 112 with the walls aligned flush against the ledges of the coaxial jacks. The mating half-casing 114 is then snapped over the jacks with its walls also flush on the ledges of the coaxial jacks. The printed wiring board 102 and the jacks mounted on the board are then secured inside the assembled half-casings without the need for additional mounting hardware. If desired, a shield 130 having circular openings 132 may be lowered over front portions of the jacks 10 protruding from the end front walls 116, 118 of the half-casings when assembled. The openings 132 have diameters sufficiently greater than the diameters of the jacks 10 to allow for variations in alignment of the jacks 10.

Figure 5:
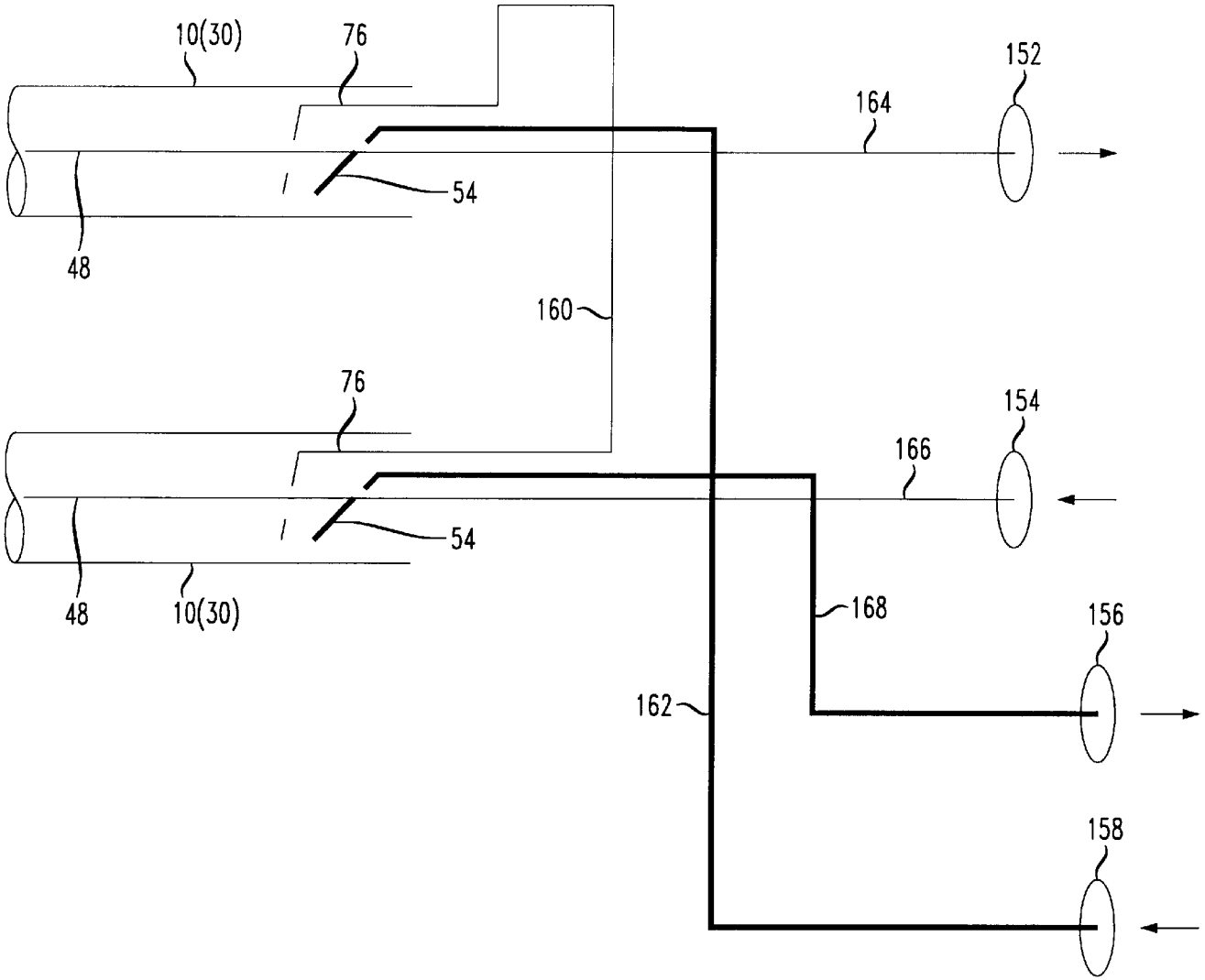
FIG. 5 is a circuit diagram showing coaxial jacks connected to enable a return loop switching configuration.

FIG. 5 is a circuit diagram showing a pair of the coaxial jacks 10 (or 30) arranged to form a "loop back" configuration with two other pairs of jack connectors 152, 154 and 156, 158. The connectors 152, 154, 156 and 158 may, for example, be conventional coaxial connectors mounted on a common case with the connectors 10, and with ground parts of all connectors properly connected with one another by the case or other appropriate means (not shown).

In FIG. 5, in the absence of plug connectors in the jacks 10, each of the first switch contacts 54 makes electrical connection with a corresponding center conductor 48, as shown. The second switch contacts 76 are connected to one another by an external or printed wire lead 160. A signal entering the jack 158 is conducted via lead 162 to the first switch contact 54 in the upper jack 10 in FIG. 5. The signal on lead 162 is thus connected to the center conductor 48 of the upper jack 10, and to lead 164 which connects the center conductor to the jack 152. Further, a signal entering the jack 154 is conducted via a lead 166 to the center conductor 48 of the lower jack 10 in FIG. 5, and, thus, to the first switch contact 54 which is in electrical connection with the center conductor. The signal is routed from the first switch contact 54 of the lower jack 10, to the jack 156 over lead 168. Accordingly, a duplex communication link is carried between the jack pair 152, 154 and the jack pair 156, 158 in the absence of patch cable plugs in the jacks 10.

When a pair of cable plugs are inserted in the jacks 10, the first switch contacts 54 inside the jacks 10 break their electrical connections with the center conductors 48, and connect instead with the second switch contacts 76. Because the second switch contacts 76 are connected together externally via the lead 160, a signal entering the jack 158 will now emerge from the jack 156 via leads 162, 160 and 168 in that order. That is, the jack 158 is looped back to the jack 156. Cables plugged into the jacks 152, 154 are connected only to corresponding center conductors 48 of the jacks 10, and a duplex communication link is defined between those cables and the patch cables plugged into the jacks 10.

Figure 6:
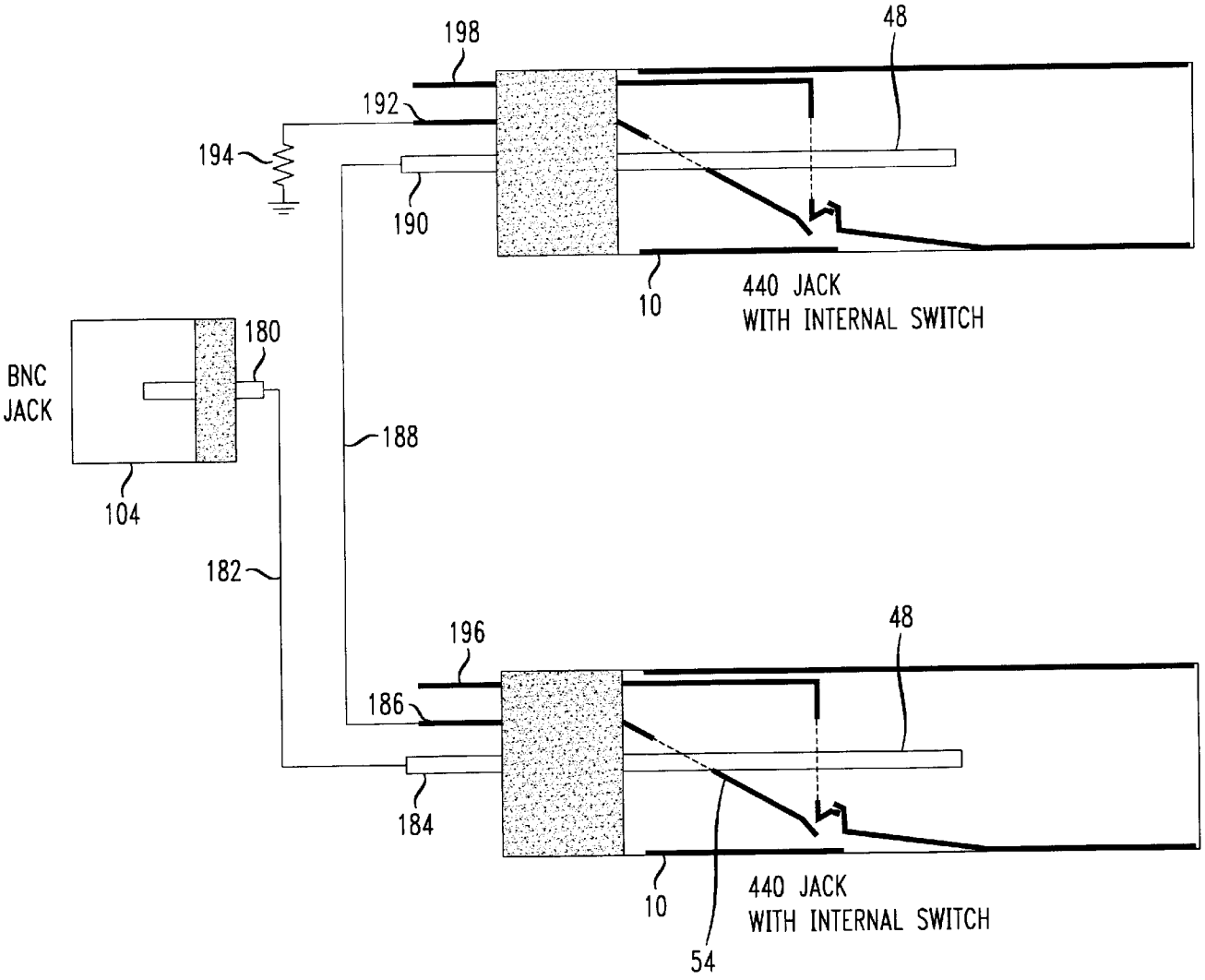
FIG. 6 is a circuit diagram showing coaxial jacks connected in a type 1201A module configuration.

FIG. 6 shows wire connection paths among two of the jacks 10 and one BNC jack 104, in the type 1201A module of FIG. 4. The same connections paths are used between the remaining BNC jack 106 and two other jacks 10. A fifth, remaining jack 10 in FIG. 4 is typically used as a monitoring jack and is coupled to the center conductor of one of the BNC jacks 104, 106 through a sampling resistor to obtain a desired attenuation as is known in the art.

A center conductor terminal 180 of the BNC jack 104 is connected via a printed wire 182 on the board 102, to a center conductor terminal 184 of the lower jack 10 in FIG. 6. A first switch contact terminal 186 on the lower jack 10 in FIG. 6, is connected via a printed wire lead 188 on the board 102 to a center conductor terminal 190 of the upper jack 10 in FIG. 6. A first switch contact terminal 192 on the upper jack 10 is connected to one side of a signal load resistor element 194, and the other side of the resistor element 194 is grounded. Second switch contact terminals 196, 198 of the jacks 10 are left unconnected in the configuration of FIG. 6.

A signal input to the BNC jack 104 is therefore delivered to the center conductor 48 of the lower jack 10. If no mating plug is inserted in the lower jack 10, the input signal is routed to the center conductor 48 of the upper jack 10 via the first switch contact 54 inside the lower jack 10. In the absence of a plug in the upper jack 10, the load resistance element 194 is connected via the first switch contact 54 in the upper jack 10 to the input signal routed to the upper jack's center conductor 48. If a plug of a first cross-connect cable is inserted in the lower jack 10, the input signal from BNC jack 104 is applied only to the first cable's center conductor. If the plug of the first cable is withdrawn from the lower jack 10 and a plug of a second cross-connect cable is inserted in the upper jack 10, then the input signal from BNC jack 104 will be switched through the lower jack to the second cable's center conductor.

Figure 7:
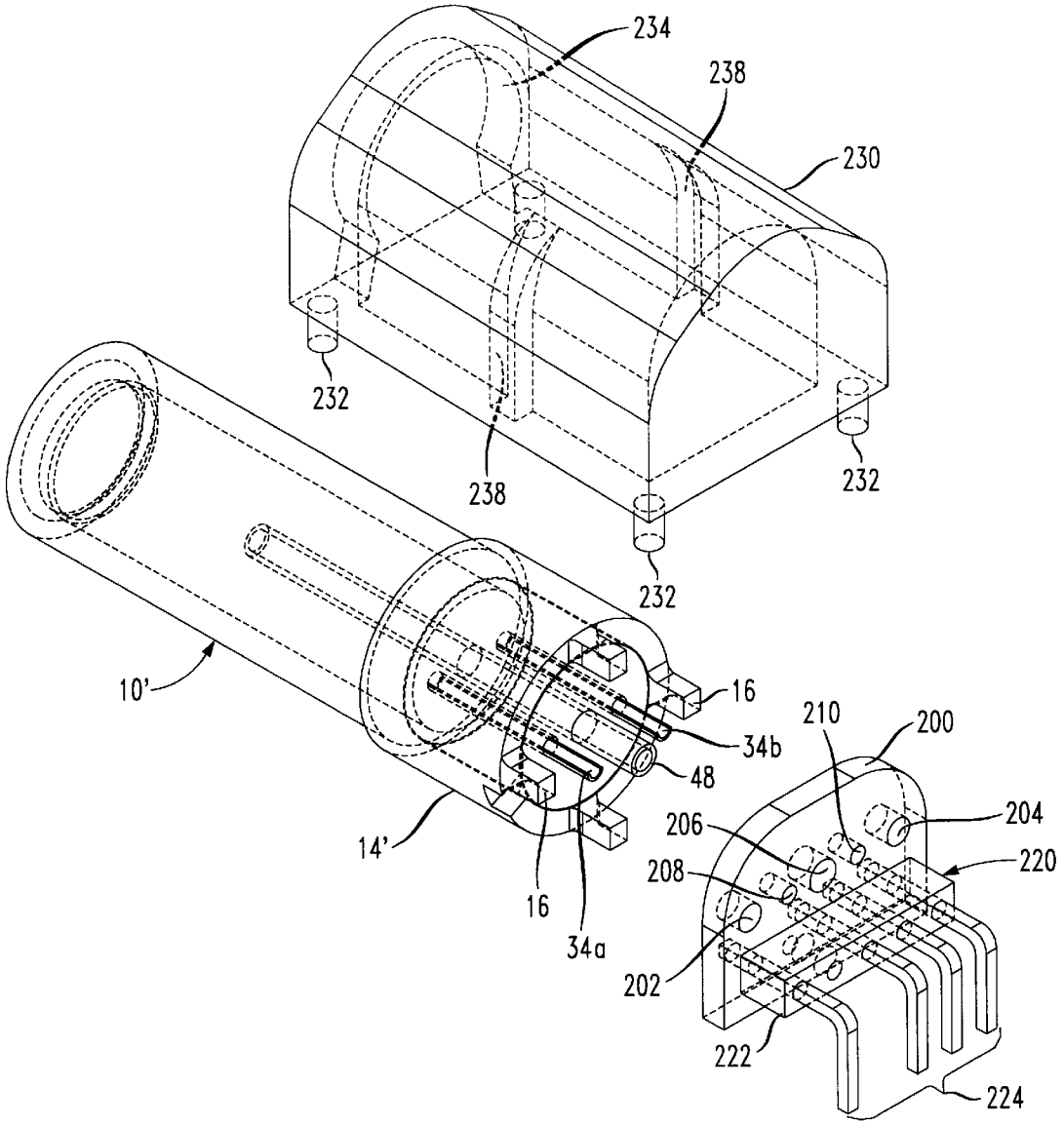
FIG. 7 shows a right-angle adaptor according to the invention to be assembled with a straight jack of the kind in FIG. 1.
Figure 8:
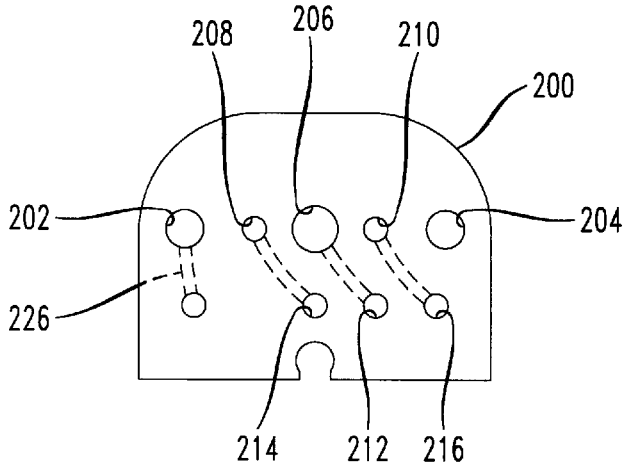
FIG. 8 shows an adaptor board that forms part of the adaptor in FIG. 7.
Figure 9:
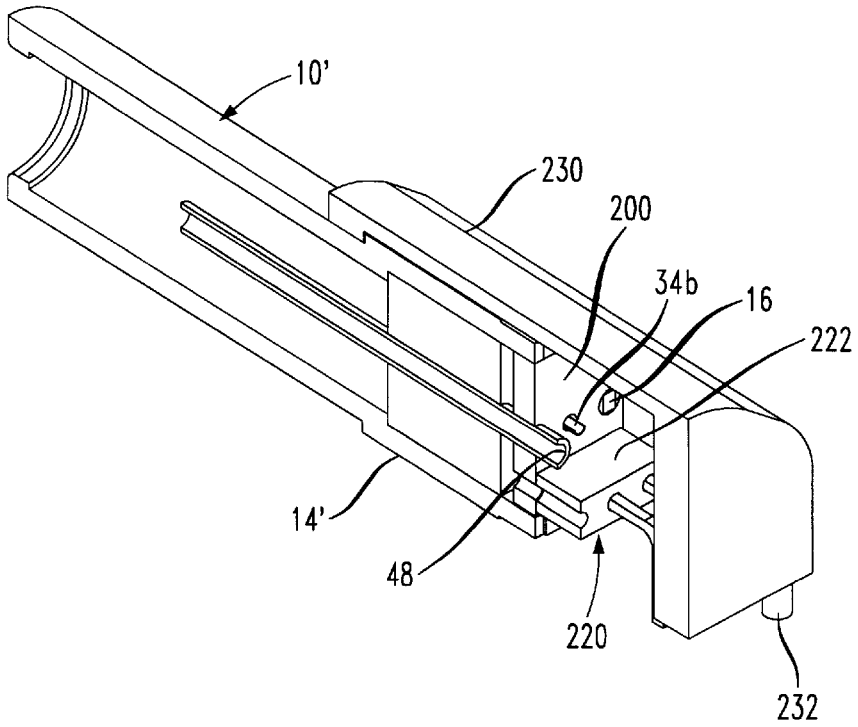
FIG. 9 is a cross-sectional view of the straight jack in FIG. 7 with the present adaptor assembled on the jack.

As mentioned earlier, it may be desirable to adapt certain "straight" coaxial jacks such as the jack 10 in FIG. 1, for right-angle mounting with respect to a printed wiring board. FIGS. 7, 8 and 9 illustrate a right-angle adaptor for coaxial jacks according to the invention.

In FIG. 7, a right-angle adaptor includes an adaptor board 200 having outer jack mounting pin openings 202, 204 located and dimensioned to receive or engage a pair of mounting pin projections 16 on the base portion 14' of straight coaxial jack 10'. Although jack base portion 14' is shown in FIG. 7 as having a circular cross-section, it will be understood that the adaptor of FIGS. 7 to 9 can be applied to straight coaxial jacks having base portions with square (e.g., FIG. 1) or other cross-sections. The outer openings 202, 204 in the board 200 may, for example, receive the pin projections 16 and fix them via a press-fit in the board 200. At least one of the openings 202, 204 is preferably conductively plated. An end part of the jack center conductor terminal 48 protrudes axially from the jack base portion 14', and is received in a conductively plated jack center terminal opening 206 in the board 200. Switch contact terminals 34*a*, 34*b* also protrude axially from the jack base portion 14' at either side of the center conductor terminal 48, and are received in corresponding, conductively plated jack switch terminal openings 208, 210 in the adaptor board 200.

Board 200 has printed or embedded conductive paths that connect the jack center terminal opening 206 and the jack switch terminal openings 208, 210; with corresponding adaptor terminal mounts 212, 214 and 216 on the board 200 as shown in FIG. 8. The mounts 212, 214, 216 are, for example, formed as conductively plated openings in the board and are aligned a certain distance below the jack terminal openings 206, 208, 210 to which they are electrically connected. Thus, when press fit or soldered in the openings 206, 208 and 210, the jack center conductor terminal 48 and the jack switch contact terminals 34*a*, 34*b* establish electrical connections with the adaptor terminal mounts 212, 214 and 216 of the adaptor 200. See FIG. 8.

A right-angle header 220 (FIGS. 7 and 9) includes a generally rectangular solid block 222. First end parts of a number of conductive, generally "L" shaped adaptor terminals 224 are supported parallel to one another by the block 222, and protrude behind the block 222 where the terminals 224 are press fit or soldered in corresponding ones of the adaptor terminal openings 212, 214, 216. The adaptor terminals are thus connected electrically to the jack switch contact terminals 34*a*, 34*b*, and to the jack center conductor terminal 48. One of the adaptor terminals 224 is preferably connected electrically to the jack housing 10' through a conductive path 226 (FIG. 8) on the board 200 and one of the jack mounting pins 16, to provide a jack ground terminal.

As shown in FIG. 7, the adaptor terminals 224 have second end parts that extend downward, substantially parallel to the adaptor board 200. In the illustrated embodiment, the adaptor terminals 224 project a certain distance beyond the periphery of the board 200, to engage part of an outside board to which a jack terminal of the jack 10' is to be connected. For example, the second end parts of the adaptor terminals 224 may be press fit or soldered in plated openings located and dimensioned on the outside board to receive the adaptor terminals 224.

After the adaptor board 200 is fitted and connected electrically to axial jack terminals at the base of the jack 10', an adaptor housing 230 is lowered over the joined jack/adaptor assembly as seen in FIG. 9. The interior of the housing 230 preferably conforms to the outer shape of the joined jack/adaptor assembly. The adaptor housing 230 may be held in place on the outside board via mounting projections 232 on bottom edges of the housing 230.

As seen in FIG. 7, an axial end wall 234 of the housing 230 is preferably configured to be "snapped" over a cylindrical forward portion of the jack body 12, by forming a circular cutout in the wall 234 which subtends more than a 180 degree arc of the outer circumference of the jack body 12. If the material of which the housing 230 is formed is sufficiently elastic, the end wall 234 will deform enough at points where it contacts the jack body to allow the body to enter the adaptor housing 230. The housing also preferably has a pair of inner vertical wall channels 238 through which side edges of the board 200 are guided while the housing 230 is lowered on the jack/adaptor assembly.

While the foregoing description represents a preferred embodiment of the invention, it will be obvious to those skilled in the art that various changes and modifications may be made, without departing from the spirit and scope of the invention as pointed out by the following claims.

We claim:

1. A right angle adaptor for a straight coaxial jack having a jack body and at least one jack terminal extending axially from a base of the jack body, said adaptor comprising:

an adaptor board having at least one jack terminal opening located and dimensioned to receive said jack terminal that extends axially from said base of said coaxial jack body;

said adaptor board having at least one adaptor terminal mount, and a conductive path that electrically connects the adaptor terminal mount to said corresponding jack terminal opening in the adaptor board; and at least one adaptor terminal one end part of which is electrically connected to said adaptor terminal mount on the adaptor board, and an opposite end part of which extends substantially parallel to the board for engaging part of an outside board to which said jack terminal of the coaxial jack is to be connected.

2. A right angle adaptor for a coaxial jack according to claim 1, wherein said adaptor terminal mount is defined by an adaptor terminal opening formed a certain distance from the corresponding jack terminal opening in the adaptor board.

3. A right angle adaptor according to claim 1, wherein said adaptor board has at least one jack body mounting pin opening located and dimensioned to receive a mounting pin projecting axially from the jack body, an adaptor ground terminal mount, and a conductive path that electrically connects the ground terminal mount to the jack body mounting pin opening in the adaptor board.

4. A right angle adaptor according to claim 1, including an adaptor housing having an interior that conforms to the base of the of a coaxial jack body with the adaptor board fixed to said base.

5. A right angle adaptor according to claim 2, including a header block overlying said adaptor terminal opening on said adaptor board, and wherein said one end part of said adaptor terminal is supported by and projects behind said header block to engage said adaptor terminal opening, and said opposite end part of the adaptor terminal extends ahead of the header block substantially parallel to the adaptor board.

6. A right angle adaptor according to claim 4, wherein said adaptor housing has at least one mounting projection for engaging an outside board.

7. A right angle adaptor according to claim 4, wherein said adaptor housing includes an axial end wall having a circular cut out that subtends more than a 180 degree arc.

8. In combination;

a straight coaxial jack having a jack body and at least one jack terminal extending axially from a base of the jack body;

a right-angle adaptor joined to said jack, said adaptor comprising, an adaptor board placed perpendicular to the axis of the jack body and having at least one jack terminal opening located and dimensioned to receive said jack terminal that extends from the base of said jack body;

said adaptor board having at least one adaptor terminal mount, and a conductive path that electrically connects the adaptor terminal mount to said corresponding jack terminal opening in the adaptor board; and at least one adaptor terminal one end part of which is electrically connected to said adaptor terminal mount on the adaptor board, and an opposite end part of which extends substantially parallel to the board for engaging part of an outside board to which said jack terminal of the coaxial jack is to be connected.

9. The combination of claim 8, wherein said adaptor terminal mount is defined by an adaptor terminal opening formed a certain distance from the corresponding jack terminal opening in the adaptor board.

10. The combination of claim 8, wherein said jack body has an axially projecting mounting pin, and said adaptor board has at least one jack body mounting pin opening located and dimensioned to receive said mounting pin, an adaptor ground terminal mount, and a conductive path that electrically connects the ground terminal mount to the jack body mounting pin opening in the adaptor board.

11. The combination of claim 8, including an adaptor housing having an interior that conforms to said jack body with the adaptor board fixed to the base of the jack body.

12. The combination of claim 9, including a header block overlying said adaptor terminal opening on said adaptor board, and wherein said one end part of said adaptor terminal is supported by and projects behind said header block to engage said adaptor terminal opening, and said opposite end part of the adaptor terminal extends ahead of the header block substantially parallel to the adaptor board.

13. The combination of claim 11, wherein said adaptor housing has at least one mounting projection for engaging an outside board.

14. The combination of claim 11, wherein said adaptor housing includes an axial end wall having a circular cut out that subtends more than a 180 degree arc of a circumference of said jack body.

* * * * *